US009421577B2

(12) United States Patent
Van Rensburg

(10) Patent No.: US 9,421,577 B2
(45) Date of Patent: Aug. 23, 2016

(54) SCREEN PANELS

(75) Inventor: Jacobus Strydom Janse Van Rensburg, Alberton (ZA)

(73) Assignee: Screenex Manufacturing (PTY) LTD., Alberton (ZA)

( * ) Notice: Subject to any disclaimer, the term of this patent is extended or adjusted under 35 U.S.C. 154(b) by 1287 days.

(21) Appl. No.: 12/162,827

(22) PCT Filed: Feb. 15, 2008

(86) PCT No.: PCT/IB2008/050556

§ 371 (c)(1),
(2), (4) Date: Jul. 31, 2008

(87) PCT Pub. No.: WO2009/101481

PCT Pub. Date: Aug. 20, 2009

(65) Prior Publication Data

US 2010/0307961 A1 Dec. 9, 2010

(30) Foreign Application Priority Data

Feb. 15, 2008 (WO) ..... PCTIB2008050556

(51) Int. Cl.
*B07B 1/49* (2006.01)
*B07B 1/46* (2006.01)

(52) U.S. Cl.
CPC ..... *B07B 1/4645* (2013.01)

(58) Field of Classification Search
CPC ..... B07B 1/46; B07B 1/4618; B07B 1/4636; B07B 1/4645; B07B 1/469
USPC ..... 209/233, 363, 392, 397–399
See application file for complete search history.

(56) References Cited

U.S. PATENT DOCUMENTS

| | | | | |
|---|---|---|---|---|
| 3,605,166 | A * | 9/1971 | Chen | 15/215 |
| 4,563,270 | A * | 1/1986 | Wolff | 209/379 |
| 4,661,245 | A * | 4/1987 | Rutherford et al. | 209/399 |
| 4,892,767 | A * | 1/1990 | Freissle | 428/52 |
| 5,699,918 | A * | 12/1997 | Dunn | 209/397 |
| 6,443,310 | B1 * | 9/2002 | Schulte et al. | 209/399 |
| 6,629,610 | B1 * | 10/2003 | Adams et al. | 209/399 |
| 2003/0012833 | A1 * | 1/2003 | Freissle et al. | 425/1 |

FOREIGN PATENT DOCUMENTS

GB 2 223 189 A 4/1990

OTHER PUBLICATIONS

UK Search Report received in corresponding Application No. GB0805256.5 dated Jul. 8, 2008.

* cited by examiner

*Primary Examiner* — Joseph C Rodriguez
*Assistant Examiner* — Kalyanavenkateshware Kumar
(74) *Attorney, Agent, or Firm* — Blank Rome LLP

(57) ABSTRACT

The invention concerns a screen panel (100) for use in vibratory screening operations. The screen panel has a rectangular bounding frame (102) and a screening surface (104) within the frame. The screening surface is formed by elongate, generally parallel, flexible screen elements (106) which are of zigzag shape in plan and which span across the frame. The zigzags of adjacent elements are out of phase with one another, and opposing zags (106.3) of adjacent elements are narrowly separated. The configuration is such that adjacent screen elements define diagonally spaced, generally rectangular screen apertures (108). The zags present generally flat, opposing surfaces (106.4).

16 Claims, 1 Drawing Sheet

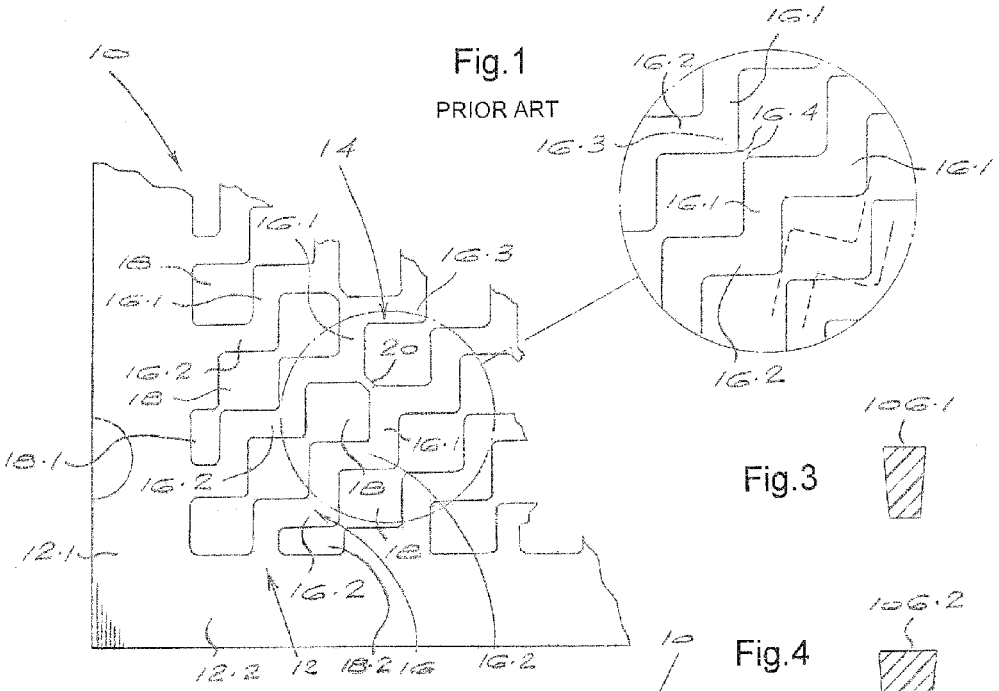
Fig.1
PRIOR ART
Fig.3
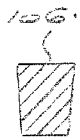
Fig.4
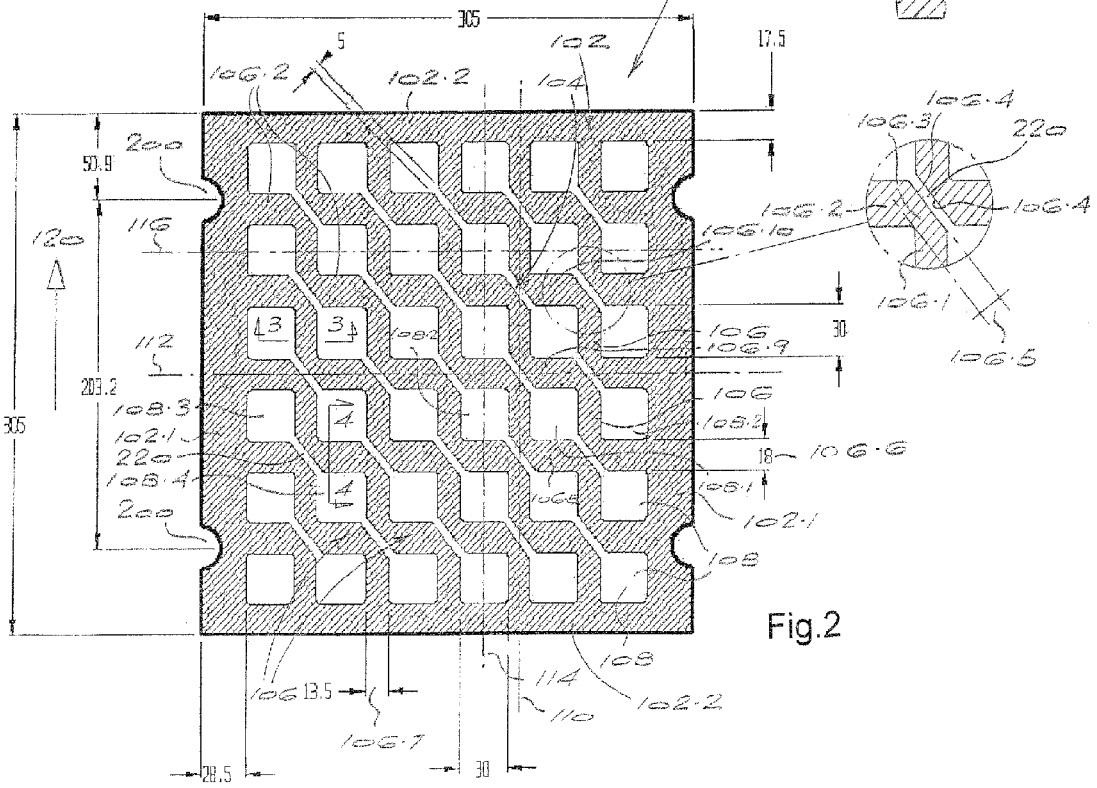
Fig.2

SCREEN PANELS

BACKGROUND TO THE INVENTION

This invention relates to screen panels, and in particular to screen panels used in vibratory screening operations.

In a vibratory screening operation, material which is to be screened is deposited on a vibrating screen deck. It is now common practice for the screen decks to have a frame and for the actual screening surface of the deck to be provided by a large number of individual screen panels which are mounted on the frame in side-by-side relationship with one another.

One particularly successful design of screen panel is that supplied by the applicant under the designation VR-X panel. This panel, which is described in ZA 2002/5151, has a rectangular outer frame defined by parallel side members and parallel end members at right angles to the side members. The screening surface of the panel is provided by arrays of parallel, flexible, elongate screen elements which are oriented generally diagonally with respect to the outer frame and span internally between members of the frame. Each of these elements has a regular zigzag profile, when viewed in plan, such profile being defined by alternating first and second portions of the elements which are generally parallel to the side members of the outer frame and generally parallel to the end members of the outer frame respectively.

The profiles of adjacent elements are out of phase with one another such that the elements define generally rectangular screen apertures between them and furthermore such that the zags of adjacent elements, where the first and second portions meet one another in each profile, are close to one another.

The overall screen surface of the screen deck is made up of the individual screen surfaces of the screen panels described above. During a screening operation, the screen deck is vibrated and particulate material is deposited on it. The configuration and vibration is such that the material migrates in a preferential feed direction on the screen deck, with the screen apertures allowing undersize particles of the material to pass through the screen surface while oversize material continues its migration in the feed direction, thereby achieving sizing of the material into undersize and oversize fractions.

While the known VR-X panels have been found to perform well in many applications, there are some instances where the flexibility and shape of the screen elements, and their geometrical relationship to one another, allow them to flex excessively apart from one another, effectively expanding the screen apertures to a size which allows particles that are unacceptably large, i.e. oversize particles, to pass through. An example is where particles derived from iron ore mining operations are screened, and the particles tend to have an elongate shape, for example a tapering, carrot-like shape.

It can happen that the pointed end of an oversize particle may lodge in a screen aperture but still be forced through the aperture as overlying material presses down on the particle and causes the aperture to expand by flexing the screen elements apart from one another.

The end result in such situations can be inaccurate screening of the ore material.

A further disadvantage of the known VR-X design is that some of the screen apertures are less than full size, leading to an overall reduction in the overall screening area and, as a result, a reduction in screening efficiency.

SUMMARY OF THE INVENTION

According to the present invention there is provided a screen panel having a rectangular frame, a screening surface within the frame comprising a plurality of elongate, generally parallel, flexible screen elements which are of zigzag shape in plan and span across the frame, the zigzags of adjacent elements being out of phase with one another with opposing zags of adjacent elements being narrowly separated, whereby adjacent screen elements define diagonally spaced, generally rectangular screen apertures between themselves, the opposing zags presenting generally flat, opposing surfaces.

In the preferred embodiment, the opposing surfaces of the zags, which may be planar, are arranged to abut one to limit the extend to which adjacent elements can be deflected apart from one another in a direction transverse to the surfaces. The elements themselves typically span diagonally across the frame, and the opposing surfaces of the zags lie in planes which are diagonal with respect to the frame.

The zigzag profile of each element is preferably defined by first portions generally parallel to opposite sides of the frame and second portions generally parallel to opposite ends of the frame.

In this specification, the term "zag" has its normal dictionary meaning of a sharp change of direction in a zigzag profile. In the context of the specification, the term accordingly refers to the position at which the first portions of the zigzag profile of each screen element meet the second portions of the profile. In other words, the term refers to the position at which the profile undergoes a sharp change of direction from generally parallel to the sides of the frame to generally parallel to the ends of the frame.

Preferably the arrangement of the elements is such that the first portions of each element are aligned, in a direction generally parallel to the sides of the frame, with first portions of each immediately adjacent element and the second portions of each element are aligned, in a direction generally parallel to the ends of the frame, with second portions of each immediately adjacent element. In the preferred configuration, the screen apertures are aligned with one another in rows and columns parallel to the ends and sides of the frame.

The zags may be defined by regions of the elements which are thinner than the first and second portions of the elements, the first and second portions may have, in cross-section, a downwardly tapering shape and portions of the elements which are oriented transverse to the direction of material flow on the screen panel in use are thicker than portions of the elements which are oriented parallel to the direction of material flow on the screen panel.

According to preferred features of the invention, all the screen apertures have the same size in plan and the frame and all the apertures are square in shape.

According to another aspect of the invention there is provided a screen panel having a rectangular frame with ends and sides, a screening surface within the frame defined by elongate, generally parallel, flexible screen elements which span across the frame and define screen apertures, the screen apertures being aligned in mutually orthogonal rows parallel to the ends and sides of the frame with diagonally adjacent screen apertures linked to one another by elongate, diagonally extending slots.

As before the apertures may be rectangular, possibly square, round or elliptical in shape.

Other features of the invention are defined in the appended claims.

BRIEF DESCRIPTION OF THE DRAWINGS

The invention will now be described in more detail, by way of example only, with reference to the accompanying drawings in which:

FIG. 1 shows a partial plan view of an existing VR-X type screen panel according to the prior art;

FIG. 2 shows a plan view of a screen panel according to the present invention;

FIG. 3 shows a cross-section at the line 3-3 in FIG. 2; and

FIG. 4 shows a cross-section at the line 4-4 in FIG. 2.

DETAILED DESCRIPTION OF THE DRAWINGS

The known VR-X screen panel 10 illustrated partially in FIG. 1 has an outer frame 12 which is rectangular in plan view and which includes outer frame side members 12.1 and outer frame end members 12.2.

Portions of only one side member and one end member are seen in FIG. 1. The frame 10 is composed predominantly of a synthetic plastics material, typically a polyurethane, or a natural or synthetic rubber. The material which is used has appropriate wear-resistant characteristics and typically has a Shore hardness in the range 40 to 90. In the frame 10, the selected material is moulded around steel reinforcing bars (not shown) which give the frame rigidity.

The screen panel 10 has a screening surface indicated generally by the numeral 14. This is defined by a series of elongate, flexible elements 16 of zigzag profile in plan view.

These elements are moulded integrally with the outer frame, but are not internally reinforced and so have a considerable degree of resilient flexibility. The elements extend generally diagonally with respect to the frame 12. The zigzag profiles of adjacent elements 16 are out of phase with one another such that the elements define diagonally spaced, rectangular screen apertures 18 between them.

Each screen element 16 consists of first portions 16.1 extending parallel to the frame side members 12.1 and second portions 16.2 extending parallel to the frame end members 12.2. The portions 16.1 and 16.2 meet one another at zags 16.3. As illustrated in the enlarged region of FIG. 1, the zags 16.3 of adjacent elements 16 have relatively sharp, opposing corners 16.4 which are narrowly spaced apart from one another.

As explained previously, the configuration illustrated in FIG. 1 has several disadvantages. In particular, it is possible for the elements to undergo substantial resilient deflection apart from one another in the event that an oversize particle, typically one having an elongate, tapering shape, becomes lodged in a screen aperture. As illustrated by the broken lines in the enlarged region of FIG. 1, it is possible for the adjacent elements to be flexed in such a way that their opposing corners 16.4 are deflected past one another, with the result that the associated screen apertures are greatly expanded to allow substantially oversize material to pass through. Such deflection of the elements can take place despite the fact that the adjacent elements are linked to one another at intervals by short bridging elements 20.

It will be understood that the result of over-expansion of the screen apertures, in the manner just described, can result in an inaccurate screening operation.

Another disadvantage of the screen panel 10 of FIG. 1 is the fact that the arrangement of the elements 16 is such that not all the screen apertures are of full size.

Reference may, for instance, be made to the partial apertures 18.1 and 18.2. The loss of full aperture size, over the full extent of the panel 10, results in an overall loss of screen surface area and reduced screening efficiency.

Reference is now made to FIGS. 2, 3 and 4 which illustrate an embodiment of the present invention. The panel 100 seen here has an outer frame 102 which is rectangular, in this case square, in plan view and which includes outer frame side members 102.1 and outer frame end members 102.2. As in the case of the panel 10, the frame 100 is composed predominantly of a synthetic plastics material, typically a polyurethane, or a natural or synthetic rubber. As before, the material which is used has appropriate wear-resistant characteristics, typically has a Shore hardness in the range 40 to 90 and is moulded around steel reinforcing bars (not shown) giving the frame rigidity.

The panel 100 has a screening surface 104 defined by elongate, flexible elements 106 of undulating, zigzag profile. Once again, the elements extend generally parallel to one another and diagonally with respect to the outer frame and are moulded integrally with the material of the outer frame but are not internally reinforced. The profiles of adjacent elements 106 are out of phase so as to define diagonally spaced, rectangular, in this case square, screen apertures 108 between them.

The zigzag profile of each screen element is composed of first portions 106.1 extending parallel to the frame side members 102.1 and second portions 106.2 extending parallel to the frame end members 102.2. The portions 106.1 and 106.2 meet one another at zags 106.3.

In accordance with the present invention the zags 106.3 are diagonally truncated so as to present substantial, generally flat opposing surfaces 106.4 which are planar and narrowly spaced apart from one another. The surfaces 106.4 lie in planes which are diagonal with respect to the frame 12.

As a result of their truncation the zags are somewhat thinner than the portions 106.1 and 106.2. This is illustrated by the fact that the dimension 106.5 is somewhat less than the dimension 106.6 or the dimension 106.7.

It will also be noted in FIG. 2 that the first portions 106.1 of each element 106 are aligned with first portions 106.1 of each immediately adjacent element 106, as exemplified by the line 110. Similarly, the second portions 106.2 of each element are aligned with second portions 106.2 of each immediately adjacent element 106, as exemplified by the line 112. The result of this configuration is that the apertures 108 are themselves aligned in rows parallel to the end frame members and in rows parallel to the side frame members, as exemplified by the apertures lying on the lines 114 and 116 respectively. Contrary to the situation with the known panel seen in FIG. 1, the apertures 108 defined between each pair of adjacent elements 106, for example the aperture designated 108.1 defined between elements 106.8 and 106.9, is aligned with apertures 108.2 defined between the next adjacent pair of elements 106.9 and 106.10.

As will be apparent from FIGS. 3 and 4, the portions 106.1 and 106.2 of the elements 106 taper downwardly in cross-section.

Typical dimensions are given in FIG. 1 for a preferred screen panel according to the invention. From these dimensions it can be seen that the portions 106.1 are somewhat thinner than the portions 106.2.

The panel 100 has several advantages when compared to the panel 10. Firstly, the truncation of the zags to provide the opposing surfaces 106.4 is advantageous in that if adjacent elements 106 should be urged apart for any reason, for example by an oversize particle, the transverse deflection which they are able to undergo will be limited by abutment of the opposing surfaces 106.4 with one another. This is in contrast to the situation with the panel 10 where the configuration is such that the zags of the adjacent elements can deflect past one another, allowing excessive expansion of the associated screen aperture.

The limitation on the deflection which the elements 106 can undergo will, it is believed, reduce the passage of oversize particles and hence improve the accuracy of the screening operation. The deflection of the elements which can take place will, it is believed, nevertheless provide the panel with sufficient ability to prevent clogging or blinding of the screen surface.

The configuration and geometry of the elements 106 also results in the formation of full-size screen apertures 108 throughout the screen surface, thereby optimizing the overall area available for screening of material.

In FIG. 2, the numeral 120 indicates the direction in which material is caused to flow over the panel by the applied vibrations during a screening operation. With this direction of movement the material impinges transversely on the portions 106.2 of the elements 106. It is therefore considered advantageous that these portions have an increased thickness to prolong the useful life of the panel.

In FIG. 2 the numeral 200 indicates recesses which extend, on the underside of the panel, into projections which locate in use in openings in the frame of the screen deck and which are used to mount the screen panel, side by side with other similar panels, to the frame. The mounting arrangement which is used may be conventional.

The narrow spaces between the opposing surfaces 106.4 of the zags of adjacent elements 106 may be seen as elongate slots which link adjacent apertures to one another. In the illustrated embodiment, the slots extend diagonally and link diagonally adjacent apertures to one another. So, for instance, the aperture 108.3 is linked to the diagonally adjacent aperture 108.4 by a diagonally extending slot 220. It will be noted that the slots 220 are aligned in parallel rows. The alignment of the apertures in mutually orthogonal rows which are parallel to the ends and sides of the rectangular panel, with diagonally adjacent apertures linked to one another by the diagonally extending slots is also seen as a novel feature of the present invention.

FIG. 2 illustrates an arrangement in which the apertures are square in shape. It is within the scope of the invention for these apertures to have other shapes, for example oblong rectangular or even round or elliptical. Irrespective of their shape, the apertures will, in accordance with the invention, be aligned in rows parallel to the sides and ends of the panel with diagonally adjacent apertures linked, as in FIG. 2, by diagonally extending slots corresponding to the slots 220. The exact shape and size of the apertures is selected according to the nature and shape of the particles which are to be screened.

The invention claimed is:

1. A screen panel having a rectangular frame, a screening surface within the frame comprising a plurality of elongate, generally parallel, flexible screen elements which are of zigzag shape in plan and span across the frame, the zigzags of adjacent elements being out of phase with one another with opposing zags of adjacent elements being narrowly separated, whereby adjacent screen elements define diagonally spaced screen apertures between themselves, the opposing zags presenting generally flat, opposing surfaces the opposing surfaces being arranged to abut to limit the extent to which adjacent elements can be deflected apart from one another in a direction transverse to the opposing surfaces.

2. A screen panel according to claim 1 wherein the opposing surfaces of the zags are planar.

3. A screen panel according to claim 1 wherein the elements span diagonally across the frame.

4. A screen panel according to claim 1 wherein the opposing surfaces of the zags lie in planes which are diagonal with respect to the frame.

5. A screen panel according to claim 1 wherein the zigzag profile of each element is defined by first portions generally parallel to opposite sides of the frame and second portions generally parallel to opposite ends of the frame.

6. A screen panel according to claim 5 wherein the arrangement of the elements is such that the first portions of each element are aligned, in a direction generally parallel to the sides of the frame, with first portions of each immediately adjacent element and the second portions of each element are aligned, in a direction generally parallel to the ends of the frame, with second portions of each immediately adjacent element.

7. A screen panel according to claim 6 wherein the screen apertures are aligned with one another in rows and columns parallel to the ends and sides of the frame.

8. A screen panel according to claim 5 wherein the zags are defined by regions of the elements which are thinner than the first and second portions of the elements.

9. A screen panel according to claim 5 wherein the first portions and second portions have, in cross-section, a downwardly tapering shape.

10. A screen panel according to claim 5 wherein portions of the elements which are oriented transverse to the direction of material flow on the screen panel in use are thicker than portions of the elements which are oriented parallel to the direction of material flow on the screen panel.

11. A screen panel according to claim 1 wherein all the screen apertures have the same size in plan.

12. A screen panel according to claim 1 wherein the frame and all the apertures are square in shape.

13. A screen panel according to claim 1 wherein the apertures are oblong rectangular, round or elliptical in shape.

14. A screen panel having a rectangular frame with ends and sides, a screening surface within the frame defined by elongate, generally parallel, flexible screen elements which span across the frame and define screen apertures, the screen apertures being aligned in mutually orthogonal rows parallel to the ends and sides of the frame with diagonally adjacent screen apertures linked to one another by elongate, diagonally extending slots defined between opposing, generally flat surfaces of the elongate screen elements, the generally flat surfaces being arranged to abut to limit the extent to which adjacent elements can be deflected apart from one another in a direction transverse to the surfaces.

15. A screen panel according to claim 14 wherein the apertures are rectangular, round or elliptical in shape.

16. A screen panel according to claim 15 wherein the frame and all the apertures are square.

* * * * *